US010381709B2

(12) United States Patent
Liang et al.

(10) Patent No.: US 10,381,709 B2
(45) Date of Patent: Aug. 13, 2019

(54) MULTI-BANS ANTENNA STRUCTURE

(71) Applicant: KEYCORE TECHNOLOGY CORP., Zhubei, Hsinchu County (TW)

(72) Inventors: Yang-Te Liang, Zhubei (TW); Po-Wei Chiu, Zhubei (TW); Sheng-Ruei Hsu, Zhubei (TW); Wei-Cheng Lin, Zhubei (TW); Chien-Jen Hsiao, Zhubei (TW); Shih-Hsiu Tseng, Zhubei (TW)

(73) Assignee: Keycore Technology Corp., Zhubei (TW)

( * ) Notice: Subject to any disclaimer, the term of this patent is extended or adjusted under 35 U.S.C. 154(b) by 123 days.

(21) Appl. No.: 15/642,337

(22) Filed: Jul. 6, 2017

(65) Prior Publication Data

US 2019/0013564 A1 Jan. 10, 2019

(51) Int. Cl.

| | |
|---|---|
| ***H01Q 1/36*** | (2006.01) |
| ***H01Q 1/00*** | (2006.01) |
| ***H01Q 5/307*** | (2015.01) |
| ***H01Q 9/04*** | (2006.01) |
| ***H01Q 1/38*** | (2006.01) |
| ***H01Q 9/42*** | (2006.01) |
| ***H01Q 21/28*** | (2006.01) |

(52) U.S. Cl.

CPC ..... *H01Q 1/005* (2013.01); *H01Q 1/36* (2013.01); *H01Q 1/38* (2013.01); *H01Q 5/307* (2015.01); *H01Q 9/0407* (2013.01); *H01Q 9/42* (2013.01); *H01Q 21/28* (2013.01)

(58) Field of Classification Search

CPC ..... H01Q 1/005; H01Q 5/307; H01Q 9/0407

See application file for complete search history.

(56) References Cited

U.S. PATENT DOCUMENTS 6,166,694 A * 12/2000 Ying ..... H01Q 1/243 343/700 MS

* cited by examiner

*Primary Examiner* — Graham P Smith

(74) *Attorney, Agent, or Firm* — C. G. Mersereau DeWitt LLP

(57) ABSTRACT

A multi-band antenna structure includes a substrate having a first wiring area located on one side surface thereof. The first wiring area has a first metal trace, a second metal trace and a connecting portion formed therein. The first and the second metal trace are respectively in an elongated spiral pattern; and the connecting portion is electrically connected at two opposite ends to the first and the second metal trace. The multi-band antenna structure can be directly integrated into electrical circuits on a circuit board to provide the advantages of reduced manufacturing cost and capable of transmitting or receiving multiple bands of signals.

12 Claims, 4 Drawing Sheets

MULTI-BANS ANTENNA STRUCTURE

FIELD OF THE INVENTION

The present invention relates to a multi-band antenna structure, and more particularly, to a multi-band antenna structure that is directly integrated into electrical circuits on a circuit board to save manufacturing cost and ensure stable receiving or transmitting of signals.

BACKGROUND OF THE INVENTION

The currently available multi-band antennas are manufactured by stamping a metal sheet into a desired shape and bending each shaped metal sheet into an antenna; and multiple shaped and bent antennas are then electrically connected to a single piece of circuit board to form a dual-polarized array multi-band antenna structure. Alternatively, the printing technique is used to print a pattern on a copper film of a circuit board for forming an antenna, and the exposure and development technique is used to produce the pattern of the antenna. Thereafter, multiple pieces of circuit boards having the antenna patterns formed thereon are stacked to form a dual-polarized array multi-band antenna structure. The multi-band antenna structure so formed can be used in different bands to receive or transmit signals. Either the stamp formed or the printed conventional multi-band antenna structure is assembled from multiple pieces of antennas to have a relatively large volume and size and requires an increased manufacturing cost. In addition, it is difficult to manufacture and install the conventional multi-band antenna structures because the multiple pieces of antennas have signal feed-in points that are not located on the same plane or at the same position.

To allow simultaneous receiving of signals in multiple bands, it is inevitably the conventional multi-band antenna structures will disadvantageously produce multiple noises when receiving multiple bands of signals. Moreover, the conventional multi-band antenna structures with the three-dimensional configuration tend to vibrate in use, which has an adverse influence on the signal transmission or receiving.

To overcome the above disadvantage, there are antenna manufacturers who try to hold the conventional multi-band antenna structures immovable or protect the same through packaging technology. Basically, the packaging can be performed via injection molding or epoxy potting. However, once the multi-band antenna structure is packaged, it could not be reworked. Therefore, it is a target of persons skilled in the art to improve the conventional multi-band antenna structures.

SUMMARY OF THE INVENTION

A primary object of the present invention is to solve the problems in the prior art multi-band antenna structures by providing a multi-band antenna structure that can be manufactured at reduced cost and can receive multiple bands of signals with reduced noise.

To achieve the above and other objects, the multi-band antenna structure provided according to the present invention includes a substrate.

The substrate has a first wiring area located on one side surface thereof. The first wiring area has a first metal trace, a second metal trace and a connecting portion formed thereon. The first and the second metal trace are respectively in an elongated spiral pattern; and the connecting portion is electrically connected at two opposite ends to the first and the second metal trace.

The multi-band antenna structure of the present invention improves the problems in the conventional multi-band antenna structures. Since the multi-band structure of the present invention can be integrated into electrical circuits on a circuit board to be manufactured along with the electrical circuits at the same time, it can be produced at increased yield and reduced manufacturing cost.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
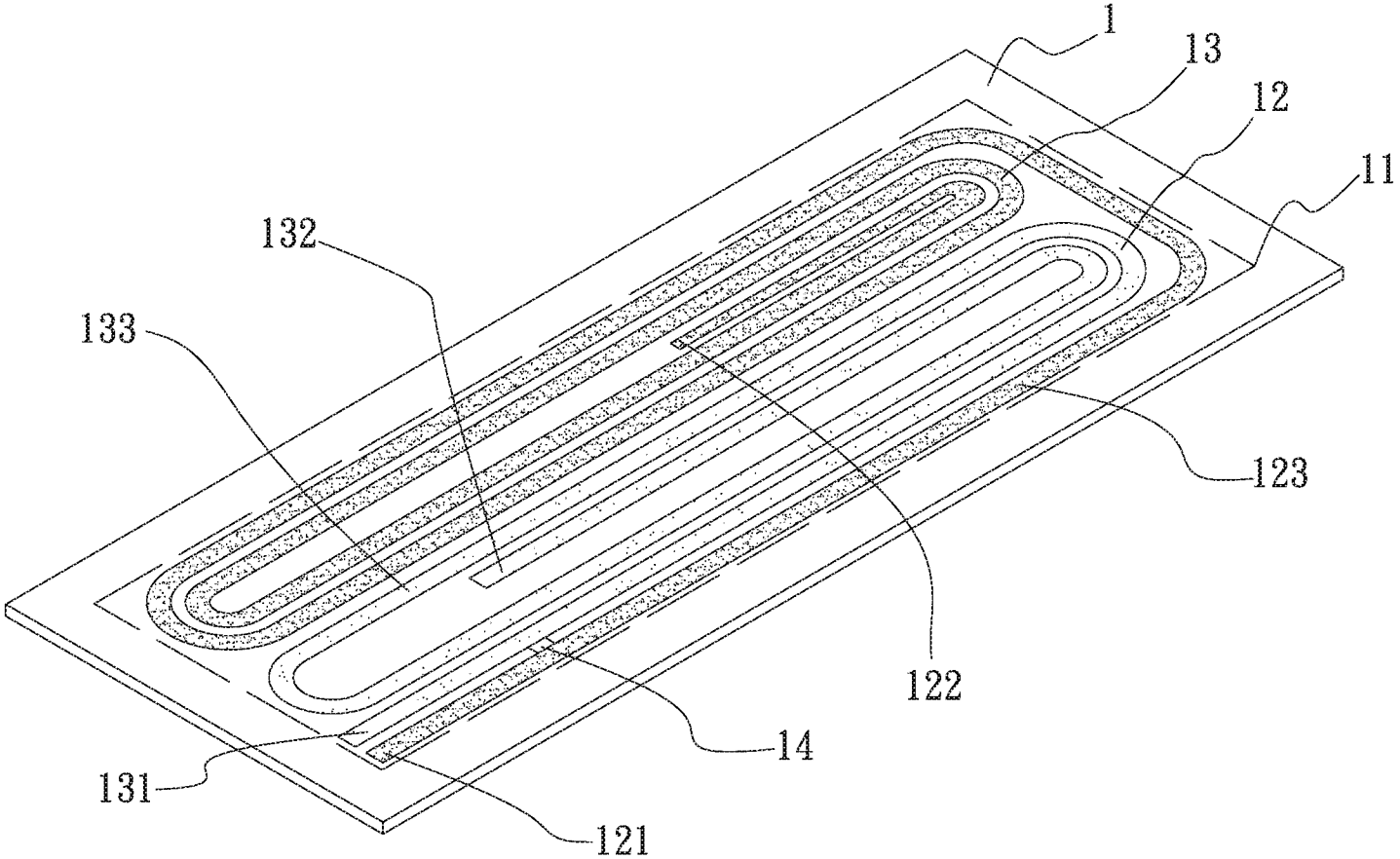
FIG. 1 is a perspective view of a multi-band antenna structure according to a first embodiment of the present invention.

The present invention will now be described with some preferred embodiments thereof and by referring to the accompanying drawings. For the purpose of easy to understand, elements that are the same in the preferred embodiments are denoted by the same reference numerals.

Figure 2:
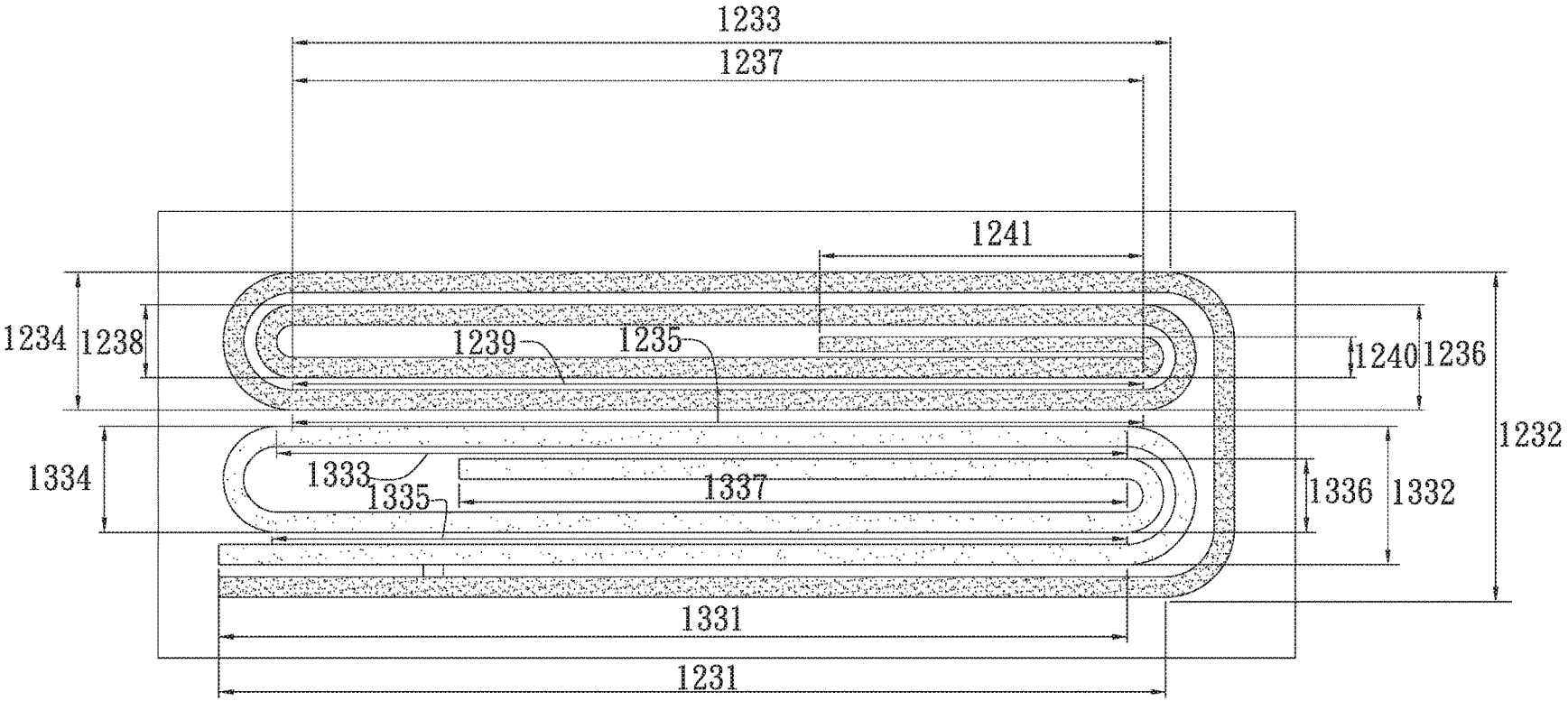
FIG. 2 is a top view of the multi-band antenna structure according to the first embodiment of the present invention.

Please refer to FIGS. 1 and 2 that are perspective and top views, respectively, of a multi-band antenna structure according to a first embodiment of the present invention. As shown, the multi-band antenna structure according to the first embodiment of the present invention includes a substrate 1.

The substrate 1 has a first wiring area 11 located on one side surface thereof. In the first wiring area 11, there are provided a first metal trace 12, a second metal trace 13 and a connecting portion 14. The first and the second metal trace 12, 13 are respectively in an elongated spiral pattern, and the connecting portion 14 is electrically connected at two opposite ends to the first and the second trace 12, 13. The substrate 1 has a thickness ranged between 0.1 mm and 1 mm.

The first metal trace 12 has a first end 121, a second end 122, and a first intermediate portion 123 located and extended between the first and the second end 121, 122. The first end 121 is located at a distance away from the second end 122. The first intermediate portion 123 is in an elongated spiral pattern with the first end 121 located at an outer side thereof and the second end 122 located at an inner side thereof.

The second metal trace 13 has a third end 131, a fourth end 132, and a second intermediate portion 133 located and extended between the third and the fourth end 131, 132. The third end 131 is located at a distance away from the fourth end 132. The second intermediate portion 133 is in an elongated spiral pattern with the third end 131 located at an outer side thereof and the fourth end 132 located at an inner side thereof.

The first end 121 of the first metal trace 12 is located adjacent to the third end 131 of the second metal trace 13. The substrate 1 can be a circuit board, a thin membrane material, or a flexible circuit board. The first metal trace 12 can receive or transmit a frequency of 315 MHz; and the second metal trace 13 can receive or transmit a frequency of 433.92 MHz. The first and the second metal trace 12, 13 respectively have a trace width of 0.5 mm and a trace spacing of 0.3 mm.

The first intermediate portion 123 of the first metal trace 12 can be divided into a first section 1231, a second section 1232, a third section 1233, a fourth section 1234, a fifth section 1235, a sixth section 1236, a seventh section 1237, an eighth section 1238, a ninth section 1239, a tenth section 1240 and an eleventh section 1241 of the first intermediate portion.

The second section 1232 of the first intermediate portion is located between and connected at two opposite ends to the first and the third section 1231, 1233 of the first intermediate portion at rounded or right angles; the fourth section 1234 of the first intermediate portion is located between and connected at two opposite ends to the third and the fifth section 1233, 1235 of the first intermediate portion at rounded or right angles; the sixth section 1236 of the first intermediate portion is located between and connected at two opposite ends to the fifth and the seventh section 1235, 1237 of the first intermediate portion at rounded or right angles; the eighth section 1238 of the first intermediate portion is located between and connected at two opposite ends to the seventh and the ninth section 1237, 1239 of the first intermediate portion at rounded or right angles; and the tenth section 1240 of the first intermediate portion is located between and connected at two opposite ends to the ninth and the eleventh section 1239, 1241 of the first intermediate portion at rounded or right angles. An overall width measured from an outer side of the first section 1231 of the first intermediate portion to an outer side of the third section 1233 of the first intermediate portion is 8 mm; and an overall width measured from the outer side of the third section 1233 of the first intermediate portion to an outer side of the fifth section 1235 of the first intermediate portion is 3.4 mm.

The second intermediate portion 133 of the second metal trace 13 can be divided into a first section 1331, a second section 1332, a third section 1333, a fourth section 1334, a fifth section 1335, a sixth section 1336 and a seventh section 1337 of the second intermediate portion.

The second section 1332 of the second intermediate portion is located between and connected at two opposite ends to the first and the third section 1331, 1333 of the second intermediate portion at rounded or right angles; the fourth section 1334 of the second intermediate portion is located between and connected at two opposite ends to the third and the fifth section 1333, 1335 of the second intermediate portion at rounded or right angles; and the sixth section 1336 of the second intermediate portion is located between and connected at two opposite ends to the fifth and the seventh section 1335, 1337 of the second intermediate portion at rounded or right angles. An overall width measured from an outer side of the third section 1333 of the second intermediate portion to an outer side of the firth section 1335 of the second intermediate portion is 2.6 mm.

The connecting portion 14 is connected at two opposite ends to the first section 1231 of the first intermediate portion and the first section 1331 of the second intermediate portion.

Figure 3:
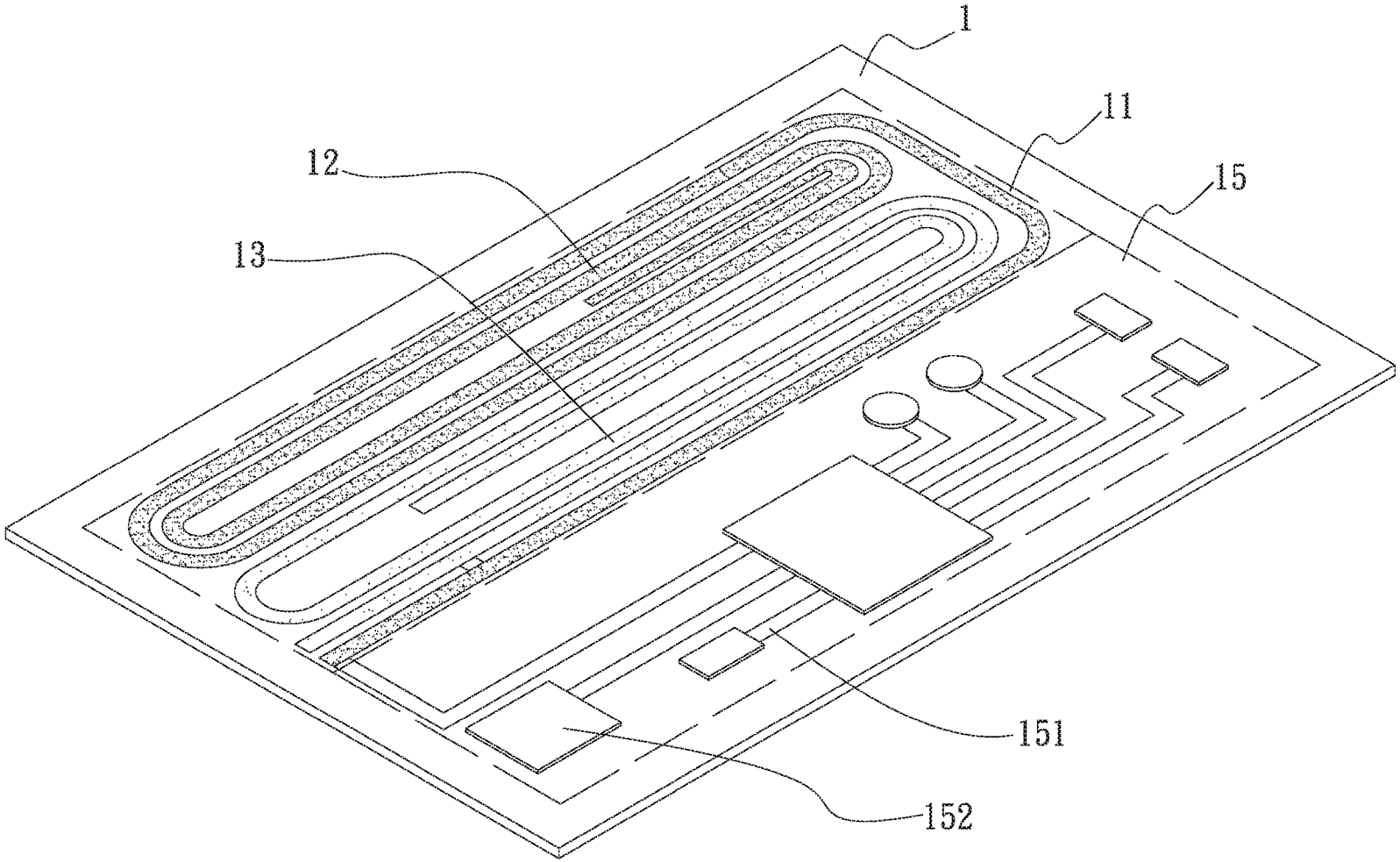
FIG. 3 is a perspective view of a multi-band antenna structure according to a second embodiment of the present invention.

Please refer to FIG. 3 that is a perspective view of a multi-band antenna structure according to a second embodiment of the present invention. Since the second embodiment is generally structurally similar to the first embodiment, the structures of the second embodiment that are the same as the first embodiment are not repeatedly described herein. The second embodiment is different from the first one in further including a second wiring area 15 on the substrate 1. As shown, the second wiring area 15 is located adjacent to one side of the first wiring area 11. In the second wiring area 15, there are provided a plurality of third metal traces 151 or a plurality of electronic elements 152. That is, according to the second embodiment, the first and the second metal trace 12, 13 for use as the multi-band antenna structure are formed in the first wiring area 11 while metal circuit traces are formed in the second wiring area 15 by printing or etching. In this way, the time and costs for manufacturing the multi-band antenna structure can be largely reduced.

Figure 4:
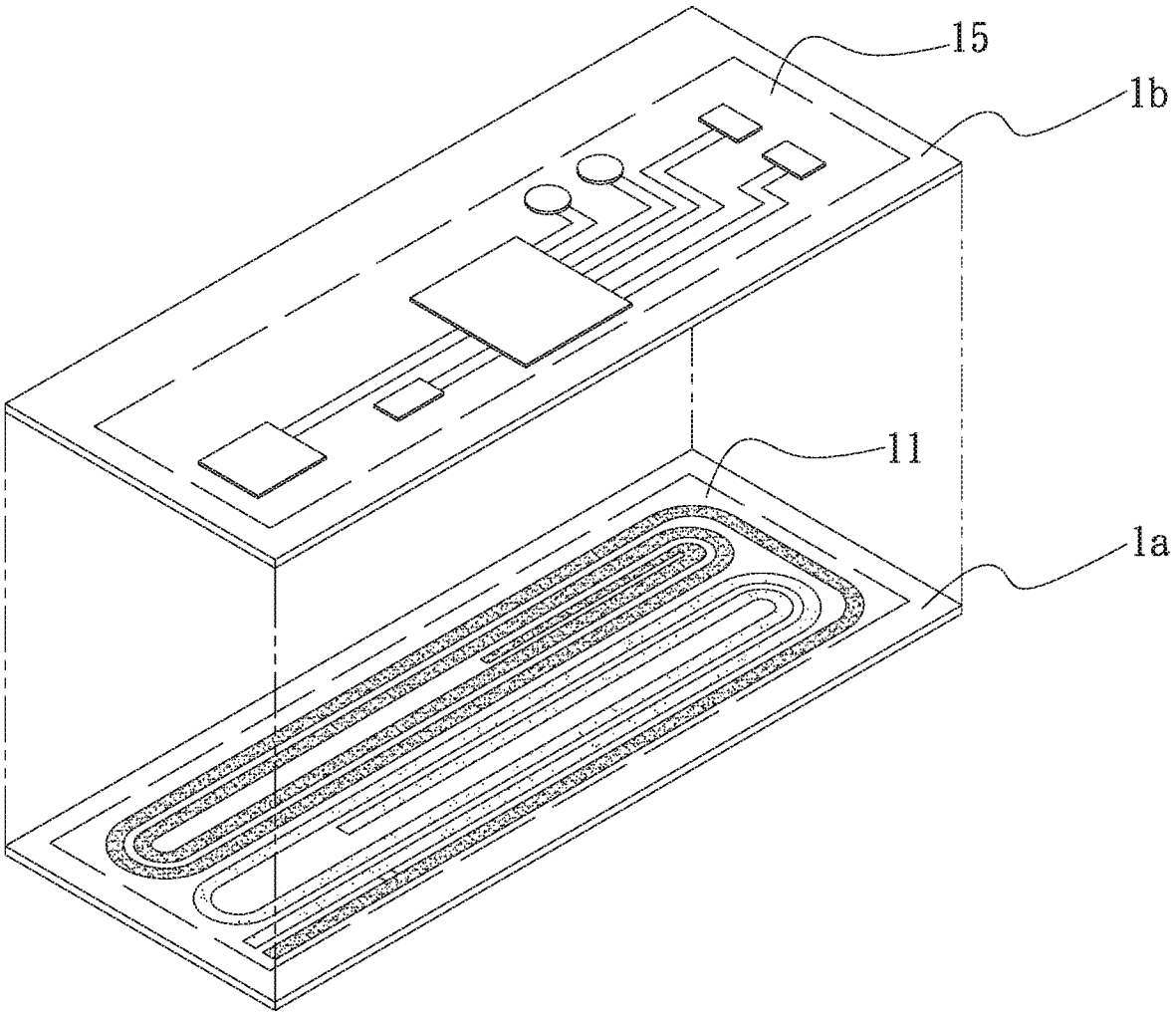
FIG. 4 is an exploded perspective view of a multi-band antenna structure according to a third embodiment of the present invention.

Please refer to FIG. 4 that is an exploded perspective view of a multi-band antenna structure according to a third embodiment of the present invention. Since the third embodiment is generally structurally similar to the first embodiment, the structures of the third embodiment that are the same as the first embodiment are not repeatedly described herein. The third embodiment is different from the first one in including a substrate 1 configured as a multilayer circuit board. In this case, the substrate 1 includes a first part 1*a* and a second part 1*b* superposed on each other. In the third embodiment, the first wiring area 11 is provided on a side surface of the first part 1*a*, and the second part 1*b* covers the side surface of the first part 1*a* having the first wiring area 11 provided thereon; and the second wiring area 15 is provided on a side surface of the second part 1*b* facing away from the first part 1*a*. According to the third embodiment, the multi-band antenna structure is integrated into one of multiple layers of electrical circuits, so that the multi-band antenna structure can be manufactured at reduced cost while the multilayer circuit board provides protection to the multi-band antenna structure.

The multi-band antenna structure of the present invention improves the conventional multi-band antenna structures and includes printed or etched metal traces that are directly formed on a circuit board to be integrated into electrical circuits on the circuit board when being manufactured. In this manner, the multi-band antenna structure can be manufactured at reduced cost and integrated into the multilayer circuit board to save a lot of space. Further, the multi-band antenna structure of the present invention overcomes the disadvantage of insufficient structural strength as found in the conventional three-dimensional multi-band antenna structures.

The multi-band antenna structure of the present invention is particularly suitable for applying to the transmitter or receiver antennas for tire pressure monitoring systems (TPMS) to achieve the effect of receiving and transmitting multiple bands using one single antenna structure. And, more particularly, the multi-band antenna structure of the present invention can improve the noise problem as found in the conventional tire pressure monitoring systems and lower the manufacturing cost thereof.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A multi-band antenna structure, comprising:

a substrate having a first wiring area located on one side surface thereof; in the first wiring area, there being provided a first metal trace, a second metal trace and a connecting portion; the first and the second metal trace being respectively in an elongated spiral pattern; and the connecting portion being electrically connected at two opposite ends to the first and the second metal trace, wherein the first and the second metal trace respectively have a trace width of 0.5 mm.

2. The multi-band antenna structure as claimed in claim 1, wherein the first metal trace has a first end, a second end located at a distance away from the second end, and a first intermediate portion located and extended between the first and the second end and being in an elongated spiral pattern with the first end located at an outer side thereof and the second end located at an inner side thereof; and wherein the second metal trace has a third end, a fourth end located at a distance away from the third end, and a second intermediate portion located and extended between the third and the fourth end and being in an elongated spiral pattern with the third end located at an outer side thereof and the fourth end located at an inner side thereof.

3. The multi-band antenna structure as claimed in claim 2, wherein the first end of the first metal trace is located adjacent to the third end of the second metal trace.

4. The multi-band antenna structure as claimed in claim 1, wherein the substrate is selected from the group consisting of a circuit board, a thin membrane material, and a flexible circuit board.

5. The multi-band antenna structure as claimed in claim 1, wherein the first metal trace can receive or transmit a frequency of 315 MHz; and the second metal trace 13 can receive or transmit a frequency of 433.92 MHz.

6. The multi-band antenna structure as claimed in claim 1, wherein the first and the second metal trace respectively have a trace spacing of 0.3 mm.

7. The multi-band antenna structure as claimed in claim 2, wherein the first intermediate portion of the first metal trace is divided into a first section, a second section, a third section, a fourth section, a fifth section, a sixth section, a seventh section, an eighth section, a ninth section, a tenth section and an eleventh section of the first intermediate portion; the second section of the first intermediate portion being located between and connected at two opposite ends to the first and the third section of the first intermediate portion at rounded or right angles, the fourth section of the first intermediate portion being located between and connected at two opposite ends to the third and the fifth section of the first intermediate portion at rounded or right angles, the sixth section of the first intermediate portion being located between and connected at two opposite ends to the fifth and the seventh section of the first intermediate portion at rounded or right angles, the eighth section of the first intermediate portion being located between and connected at two opposite ends to the seventh and the ninth section of the first intermediate portion at rounded or right angles, and the tenth section of the first intermediate portion being located between and connected at two opposite ends to the ninth and the eleventh section of the first intermediate portion at rounded or right angles; an overall width measured from an outer side of the first section of the first intermediate portion to an outer side of the third section of the first intermediate portion being 8 mm; and an overall width measured from the outer side of the third section of the first intermediate portion to an outer side of the fifth section of the first intermediate portion being 3.4 mm.

8. The multi-band antenna structure as claimed in claim 2, wherein the second intermediate portion of the second metal trace is divided into a first section, a second section, a third section, a fourth section, a fifth section, a sixth section and a seventh section of the second intermediate portion; the second section of the second intermediate portion being located between and connected at two opposite ends to the first and the third section of the second intermediate portion at rounded or right angles, the fourth section of the second intermediate portion being located between and connected at two opposite ends to the third and the fifth section of the second intermediate portion at rounded or right angles, and the sixth section of the second intermediate portion being located between and connected at two opposite ends to the fifth and the seventh section of the second intermediate portion at rounded or right angles; and an overall width measured from an outer side of the third section of the second intermediate portion to an outer side of the firth section of the second intermediate portion being 2.6 mm.

9. The multi-band antenna structure as claimed in claim 2, wherein the substrate has a thickness ranged between 0.1 mm and 1 mm.

10. The multi-band antenna structure as claimed in claim 2, wherein the connecting portion is connected at two opposite ends to a first section of the first intermediate portion and a first section of the second intermediate portion.

11. The multi-band antenna structure as claimed in claim 1, wherein the substrate is a multilayer circuit board including a first part and a second part superposed on each other; the first wiring area being provided on a side surface of the first part, and the second part covering the side surface of the first part that has the first wiring area provided thereon; and the second wiring area being provided on a side surface of the second part that faces away from the first part.

12. The multi-band antenna structure as claimed in claim 1, wherein the substrate further has a second wiring area located adjacent to one side of the first wiring area; and the second wiring area having a plurality of third metal traces or a plurality of electronic elements provided thereon.

* * * * *